US007753170B1

(12) United States Patent
Gibson

(10) Patent No.: US 7,753,170 B1
(45) **Date of Patent: *Jul. 13, 2010**

(54) LADDER TOP FOR RETAINING A LADDER AGAINST EXTRINSIC SURFACES

(75) Inventor: Donald L. Gibson, Louisville, KY (US)

(73) Assignee: Louisville Ladder Inc., Louisville, KY (US)

( * ) Notice: Subject to any disclaimer, the term of this patent is extended or adjusted under 35 U.S.C. 154(b) by 167 days.

This patent is subject to a terminal disclaimer.

(21) Appl. No.: 11/689,179

(22) Filed: Mar. 21, 2007

Related U.S. Application Data

(63) Continuation-in-part of application No. 11/539,866, filed on Oct. 9, 2006.

(51) Int. Cl.
*E06C 7/00* (2006.01)

(52) U.S. Cl. ..... 182/107; 182/108; 182/129; 248/210

(58) Field of Classification Search ..... 182/87, 182/107, 108, 116, 129, 173, 187; 248/65, 248/210, 219.2, 219.3, 219.7; 220/570; 211/126.1
See application file for complete search history.

(56) References Cited

U.S. PATENT DOCUMENTS 1,974,572 A * 9/1934 Laflin ..... 182/13
2,234,944 A * 3/1941 Rich et al. ..... 182/125
2,808,975 A * 10/1957 Palmquist ..... 182/107
2,870,948 A * 1/1959 Lundgren ..... 182/214
2,925,877 A * 2/1960 Wright ..... 182/108
3,020,972 A * 2/1962 Hockett ..... 182/15
3,022,898 A * 2/1962 Loeb ..... 211/64
3,037,579 A * 6/1962 Barrow ..... 182/107
3,057,431 A * 10/1962 George ..... 182/163
3,100,026 A * 8/1963 Sunshine ..... 182/214
3,318,415 A * 5/1967 Christie, Sr. ..... 182/116
3,715,012 A * 2/1973 Perry ..... 182/107
4,121,692 A * 10/1978 Morawski ..... 182/129
4,261,435 A * 4/1981 Winter ..... 182/129
4,363,378 A * 12/1982 Williams et al. ..... 182/93
4,552,247 A * 11/1985 Purdy ..... 182/116
4,601,364 A * 7/1986 York ..... 182/187
4,787,476 A * 11/1988 Lee ..... 182/116
4,928,793 A * 5/1990 Westimayer et al. ..... 182/187
5,016,732 A * 5/1991 Dunn ..... 182/116
5,156,096 A * 10/1992 Lamprey ..... 108/152
D340,773 S 10/1993 Bartnicki et al.
5,259,480 A 11/1993 Bartnicki et al.

(Continued)

FOREIGN PATENT DOCUMENTS

GB 2207453 A * 2/1989 ..... 182/107

*Primary Examiner*—Katherine W Mitchell
*Assistant Examiner*—Colleen M Quinn
(74) *Attorney, Agent, or Firm*—Egbert Law Offices PLLC

(57) ABSTRACT

A cover for a ladder top has a top panel, a front side extending downwardly from one side of the top panel and indentation formed therein, and a belt connected to the top panel for maintaining the front side of the top panel in juxtaposition against an extrinsic surface. The indentation has a generally V-shape. A first slot is formed on one side of the indentation and a second slot is formed on the other side of the indentation. The belt extends through both the first and second slots.

5 Claims, 4 Drawing Sheets

U.S. PATENT DOCUMENTS 5,267,632 A * 12/1993 Mintz ..... 182/116
5,358,070 A 10/1994 Bartnicki et al.
5,460,241 A * 10/1995 LaBelle ..... 182/214
5,573,081 A 11/1996 Bartnicki et al.
5,622,238 A * 4/1997 Farmer ..... 182/214
5,722,507 A * 3/1998 Kain ..... 182/129
D413,990 S 9/1999 Bartnicki et al.
5,950,972 A * 9/1999 Irish ..... 248/210
D422,717 S 4/2000 Bartnicki et al.
6,354,400 B1 * 3/2002 Purkayastha ..... 182/107
6,354,401 B2 * 3/2002 Murray ..... 182/214
6,729,441 B1 * 5/2004 Nahlen ..... 182/206
6,817,446 B1 * 11/2004 Bisland ..... 182/187
6,823,998 B2 * 11/2004 Fabregas ..... 211/70.6
7,063,187 B1 * 6/2006 Lavigne ..... 182/129
7,159,694 B2 * 1/2007 Gibson ..... 182/165
7,168,521 B1 * 1/2007 Murray ..... 182/127
D549,356 S * 8/2007 Gibson et al. ..... D25/68
2002/0104709 A1 * 8/2002 Hines ..... 182/129
2008/0017447 A1 * 1/2008 Sheridan et al. ..... 182/107

* cited by examiner

LADDER TOP FOR RETAINING A LADDER AGAINST EXTRINSIC SURFACES

CROSS-REFERENCE TO RELATED U.S. APPLICATIONS

The present application is a continuation-in-part of U.S. application Ser. No. 11/539,866, filed on Oct. 9, 2006, and entitled "Ladder Top for Supporting a Ladder Against Flat and Non-Flat Surfaces", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a ladder top. More particularly, the present invention relates to a ladder top versatilely made for holding tools as well as for resting against a variety of shaped surfaces, including but not limited to a flat support surface, the corner of a building, a square pole, a round pole, and trees. The present invention also relates to ladders that are adapted to be used against and supported by such surfaces.

2. Description of Related Art Including Information Disclosed Under 37 CFR 1.97 and 37 CFR 1.98.

Ladders are commonly used as a means for elevating persons to a specified height to perform a specified function. Users of ladders climb a series of steps, or rungs, to reach a desired height. All ladders are finite in height and have a top step which is the highest step and above which no other step exists. Prior art refers to this top step as the ladder top. Ladder tops are typically adapted to fit to the ladder body, which consists of the remaining rungs and any legs of the ladder.

Ladders are typically found in two categories: ladders that have a support means incorporated within the design of the ladder and ladders that use extrinsic surfaces for support. Sometimes, ladders with support means incorporated within their design are folded or used in ways that utilize extrinsic surfaces for support. For ladders that use extrinsic surfaces for support, the ladder top is the only portion of the ladder that actually contacts the extrinsic surface. Further, only a portion of the ladder top actually contacts the extrinsic surface.

Regardless of the ladder type, the only extrinsic surface that safely supports prior art ladder tops is a flat surface, or wall. Surfaces such as round poles, square poles, wall corners, and trees cannot support a ladder because the ladder tops of the prior art will tilt or slip from any non-flat surface.

For example, U.S. Pat. No. 5,259,480, issued on Nov. 9, 1993, to Bartnicki et al., discloses a ladder top for a self-supporting ladder. The ladder top has four side walls and a top panel. The top panel has at least four edges corresponding with each side wall. The four edges connect the top panel to a first, second, third, and fourth side wall. The third and fourth side walls connect the first and second side walls so as to form a rectangular-shaped ladder top. The third and fourth side walls are adapted to connect to the ladder legs. The top panel and first side wall have slots and holes in them so as to act as trays or surfaces for placing equipment, thus enabling a user to better handle tools and paint cans on the ladder top. The second sidewall has a hook from which to hang a can of paint.

U.S. Pat. No. 5,358,070, issued on Oct. 25, 1994, to Bartnicki et al., discloses a ladder top similar to that disclosed in the '480 patent, except that the second side wall has hook. The top panel and first side wall of the ladder top have holes and slots to hang and place tools as desired by the user. One of the holes in the top panel is a large hole that uses crossed-support members running along the diagonal of the bottom of the top panel so as to support a can of paint instead of using a hook as in the '480 patent.

U.S. Pat. No. 5,573,081, issued on Nov. 12, 1996, to Bartnicki et al., discloses a ladder top similar to that disclosed in the '480 and '070 patents, except that the second side wall is limited to having an arcuate depression and a hook. Holes and slots in the top panel and first side wall are used to hang and place tools and equipment as desired by the user. Structural members extend across the bottom of the top panel so as to provide support for a can of paint, and a hook on the second side wall allows the ladder user to hang a paint can from the ladder top. The arcuate depression in the second side wall exists to accommodate the arcuate shape of the bail of a paint bucket as well as move the weight of the bucket closer to the center of the ladder.

U.S. Design Pat. No. 422,717, issued on Apr. 11, 2000, to Bartnicki, et al., discloses a ladder top design. The ladder top design has a top panel and four side walls. The top panel has a surface and an underside. The surface of the top panel is ornamented with a circular recessed area on one side, a rectangular recessed area on the other side, a large slot near the rectangular recessed area, and a small slot near the circular recessed area. The circular recessed area has several levels of recess. The first level is a circle imprinted in the surface of the ladder top. The circle is of a diameter larger than the width of the ladder top. Within the first level of the circular impression is a second level which is a circle with a diameter smaller than that of the first level and also with a hole in the center.

U.S. Design Pat. No. 413,990, issued on Sep. 14, 1999, to Bartnicki, et al., discloses a design for the front face of a ladder top. Specifically, the patent covers a design of six embodiments for the front face of a ladder top. The first embodiment has two horizontal slots cut out of the plastic mold near the top of the wall. Twelve triangular recessed areas are formed so as to make a design for the wall. In the center of the triangular impressions is an elliptical logo. The second embodiment has two horizontal slots cut out of the plastic mold near the top of the wall. Twelve triangular areas are cut out of the plastic mold so as to make a design for the wall. The third embodiment has two horizontal slots cut out of the plastic mold near the top of the wall. Twelve triangular recessed areas are formed so as to make a design for the wall. The fourth embodiment has twelve triangular recessed areas formed so as to make a design for the wall. The fifth embodiment has two horizontal slots cut out of the plastic mold near the top of the wall. Twelve triangular areas are cut out of the plastic mold so as to make a design for the wall. The sixth embodiment has twelve triangular areas cut out of the plastic mold so as to make a design for the wall.

U.S. Design Pat. No. 340,773, issued on Oct. 26, 1993 to Bartnicki, et al., discloses a ladder top design. The ladder top has a top panel and four side walls. The top panel has a surface and an underside. The surface of the top panel has three general sections. The first section is near one side of the top panel and has three holes cut out of the plastic mold. One hole is larger than the other two, and the other two holes are the same size. The middle section has one large hole cut out of the plastic mold, and the second section is near the other side of the top panel and has two holes cut out of the plastic mold. One hole is substantially larger than the other hole. The surface of the top panel has parallel lines that run parallel to the diagonals of the top panel.

All of the above identified ladder tops accommodate only flat extrinsic support surfaces. They are not suitable for being rested against non-flat surfaces, such as poles, pipes or building corners.

It is often desirable to fix the top of the ladder against a particular surface. This is particularly the case where the ladder is rested against the side of a pole or other tubular object. Under such circumstances, if the top of the ladder is not fixed against the tubular surface or object, the ladder may become unstable. Heretofore, there have not been ladder covers which include suitable tool slots that can also be adapted receiving belts and/or other fixing means for the purpose of retaining the top of the ladder in a fixed position against the exterior surface or object.

It is an object of the present invention to provide a ladder top or cover that can be utilized against flat and non-flat support surfaces.

It is another object of the present invention to provide a ladder top that has the ability to hold tools and accessories.

It is a further object of the present invention to provide a ladder top that can be effectively and safely positioned against flat and non-flat support surfaces, such as walls, corners, poles and trees.

It is a further object of the present invention to provide a ladder and the top of the ladder which can be securely retained against tubular objects, poles or trees so as to enhance the stability of the ladder under such circumstances.

These and other objects and advantages of the present invention will become apparent from a reading of the attached specification and appended claims.

BRIEF SUMMARY OF THE INVENTION

The present invention is a ladder top that comprises a top panel, a front side extending downwardly from one side of the top panel and a fixing means connected to the top panel for maintaining the front side of the top panel in juxtaposition against an extrinsic surface or object. The front side has an indentation formed therein.

In particular, in the present invention, the top panel has a first slot formed on one side of the indentation and a second slot formed on an opposite side of the indentation. Each of the slots extend along a line so as to form a generally 90° angle with respect to each other. Each of the first and second slots has a length suitable for receiving a putty knife therein.

The fixing means of the present invention particularly includes a belt that extends through both of the first slot and second slot. As used herein, the term "belt" can refer to a wide variety of particular devices such as straps, bungee cords, wires, strings, rope and similar items. The belt has a surface suitable for extending around the extrinsic surface so that the extrinsic surface is interposed between the belt and the indentation. The belt includes a tightening means cooperative therewith for tightening the belt against the extrinsic surface and for fixing the belt in the tightened position. The belt extends below and underside of the top panel between the first and second slots.

In the present invention, the indentation has a generally V-shape. The top panel has a pair of recessed pans formed therein. The first slot is formed in one of the pair of recessed pans. The second slot is formed in another of the pair of recessed pans. The front side has a plurality of ribs extending thereacross. At least some of the plurality of ribs contacts the extrinsic surface.

The present invention is also a ladder cover which is attached to the upper end of a ladder.

DETAILED DESCRIPTION OF THE INVENTION

Figure 1:
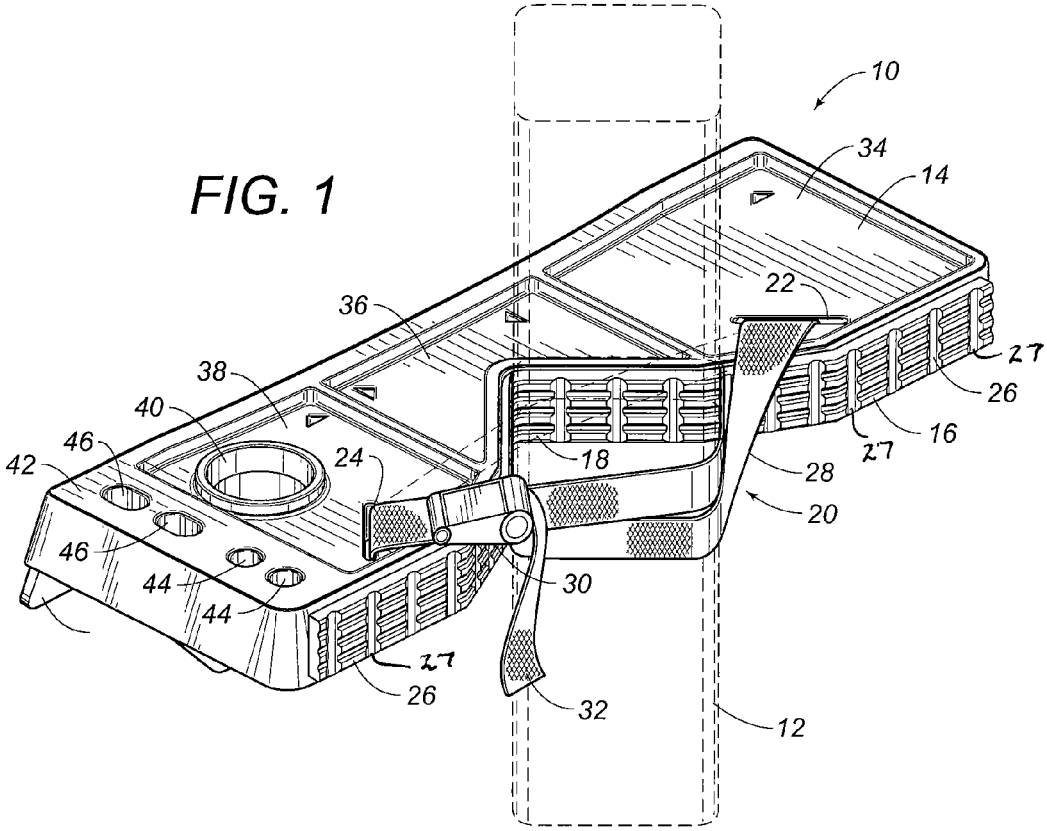
FIG. 1 is a perspective view of the present invention showing the present invention as secured against a pole (illustrated in broken line fashion).

Referring to FIG. 1, there is shown the ladder top 10 in accordance with the teachings of the preferred embodiment of the present invention. The ladder top 10 is illustrated as secured against a pole 12. The pole 12 is generally a square cross-section pole. However, within the concept of the present invention, the pole 12 can be in the nature of a tree, a rod, a tubular member and various other related items. The ladder top 10 includes a top panel 14 and a front side 16 extending downwardly from one side of the front panel 14. The front side 16 has an indentation 18 formed therein. A fixing means 20 is connected to the top panel 14 for maintaining the front side 16 in juxtaposition against the extrinsic surface, namely, pole 12.

In particular, it can be seen in FIG. 1 that the top panel 14 includes a first slot 22 and a second slot 24 formed therein. Each of the slots 22 and 24 are formed on opposite sides of the indentation 18. The first slot 22 and the second slot 24 extend along a line so as to form a 90° angle with respect to each other. Generally, the slots 22 and 24 will extend in generally parallel relationships to the sides of the indentation 18. Each of the slots 22 and 24 has a length suitable for receiving a putty knife therein. Typically, the slots 22 and 24 will have a length of between ¾ inch and 1½ inches.

The front side 16 has a plurality of ribs 26 formed thereacross. These ribs extend across the surface of the indentation 18 so as to provide a gripping surface for securely establishing contact with the exterior surface of the pole 12. At least some of the ribs 26 will contact the outer surface of the pole 12. It can be seen that a plurality of indentations 27 are formed vertically in the plurality of ribs 26.

The fixing means 20 of the present invention is, in particular, a belt 28 which extends through each of the slots 22 and 24. The belt 28 has a surface suitable for extending around the outter surface of the pole 12 such that the pole is interposed between the belt 28 and the indentation 18. The belt includes a tightening means 30, such as a buckle, so as to facilitate the tightening of the belt 28 against the exterior surface of the pole 12 and for fixing the belt 28 in this tightened position. As will be describes hereinafter, the belt 28 can have a portion extending below a top panel 14 and can be wrapped around, in two layers, around the extrinsic surface of the pole 12.

In the manner illustrated in FIG. 1, the ladder top 10 is securely affixed against the pole 12. As such, once the belt 28 has been fixed around the pole 12, the ladder will be in a secure position. This greatly enhances the stability of the ladder and avoids the situation where the ladder may become dislodged from the pole. It is relatively easy to install the belt 28 since the putty knife slots 22 and 24 are formed with the ladder top 10. If the ladder top 10 is not used in association with the pole 12, or other tubular object, then the ladder top 10 can be used in a conventional manner with the flat surface of the front side 16 resting against the flat extrinsic surface. The slots 22 and 24 can also be used, under such circumstances, as a putty knife holder. When it is desired to release the ladder top 10 from the pole 12, a gentle tug on the end 32 of belt 28 will release the tightening means 30 so as to allow the belt 28 to unravel and be released from the pole 12.

In FIG. 1, it can be seen that the top panel 14 includes a first pan 34, a second pan 36 and third pan 38. The slot 22 is formed in the first pan 34. The indentation 18 extends into the second pan 36. The second slot 24 is formed in the third pan 38. These pans 34, 36 and 38 can be used so as to accommodate various tools, small objects, or other requirements of the person using the ladder top 10. Under certain circumstances, nails, screws, washers, bolts, and other items can be received of each of the panels 34, 36 and 38. A large diameter hole 40 is formed into the third pan 38. Hole 40 can receive various tubular-handled objects, such as paint brushes, the shanks of hammers, screwdrivers, and other items. A shelf 42 is formed at one end of the ladder top 10. Shelf 42 has a pair of circular holes 44 formed therethrough. Also a pair of elongated holes 46 are formed on the shelf 42. Holes 44 and 46 can be used so as to receive various tools therein. As such, the ladder cover 10 facilitates the ability of a workman to bring the tools and equipment to the top of the ladder for use in work in an area adjacent to the pole 12. The ladder top 10 also includes a backside 48 extending downwardly from the top panel 14 at a side opposite to the front side 16.

Figure 2:
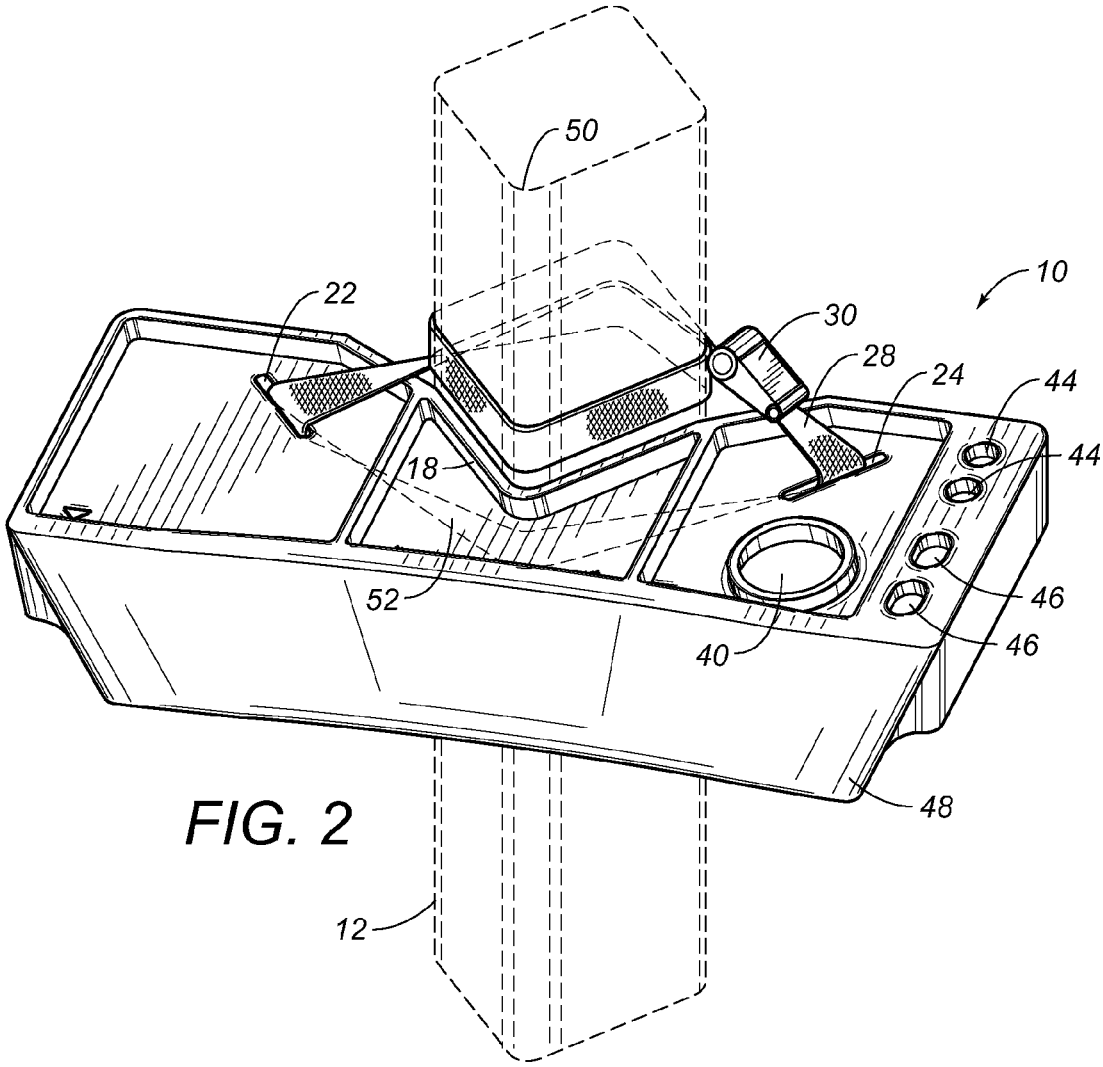
FIG. 2 is a rear perspective view of the ladder top of the present invention as secured around a pole with the ladder cover illustrated transparently so as to illustrate the position of the belt.

FIG. 2 shows the application of the ladder top 10 to the pole 12. In FIG. 2, the backside 48 of the ladder top 10 is particularly illustrated. The corner 50 of the pole 12 is secured within the V-shape indentation 18. The belt 28 is wrapped around the pole 12 so as to secure the pole. A portion 52 will extend below the bottom side of the ladder top 10 and extend between the first slot 22 and the second slot 24. The tightening means 30 is illustrated as positioned adjacent to the slot 24. The belt 28 will extend through the tightening means 30. Within the concept of the present invention, various devices can be used as the "tightening means" 30. Such items can include buckles, clasps, clips, brackets, clamps, along with related-type items.

In FIG. 2 the ladder top 10 is illustrated in a transparent fashion so that the position of the wrapping of the belt 28 can be easily seen. The ladder top 10 can be formed of an injection-molded polymeric material. The various holes 40, 44 and 46 are illustrated as extending through the ladder top 10 so as to open therebelow.

Figure 3:
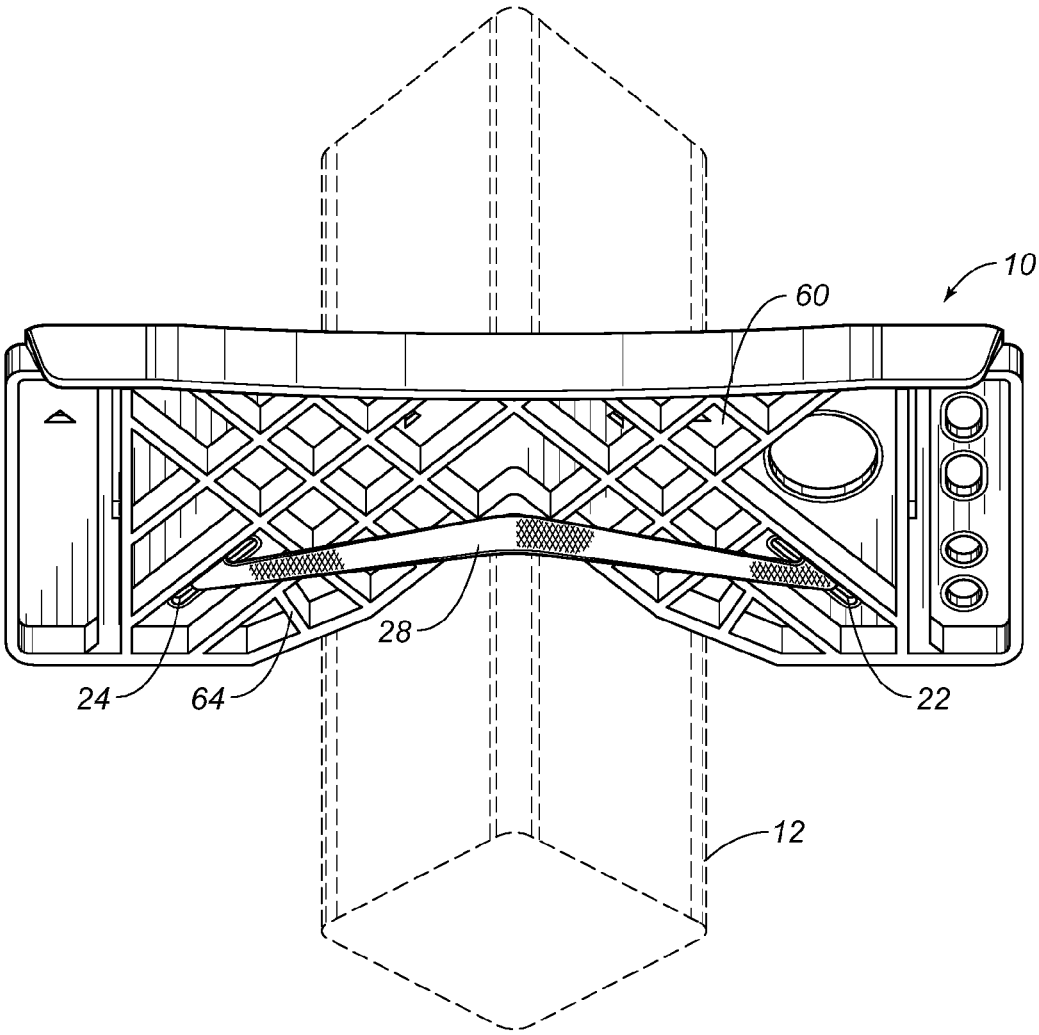
FIG. 3 is a bottom perspective view showing the ladder cover of the present invention as secured to a pole.

FIG. 3 is a bottom view of the ladder top 10 illustrating, in particular, the underside 60 of the ladder top 10. The underside 60 includes an array of crosshatchings 64 extending thereacross. Each of the slots 22 and 24 open to the underside 60 of the ladder top 10. The belt 28 has a portion which extends across the underside 60 between each of the slots 22 and 24. This serves to securely retain the ladder top 10 against the exterior surface of the pole 12.

Figure 4:
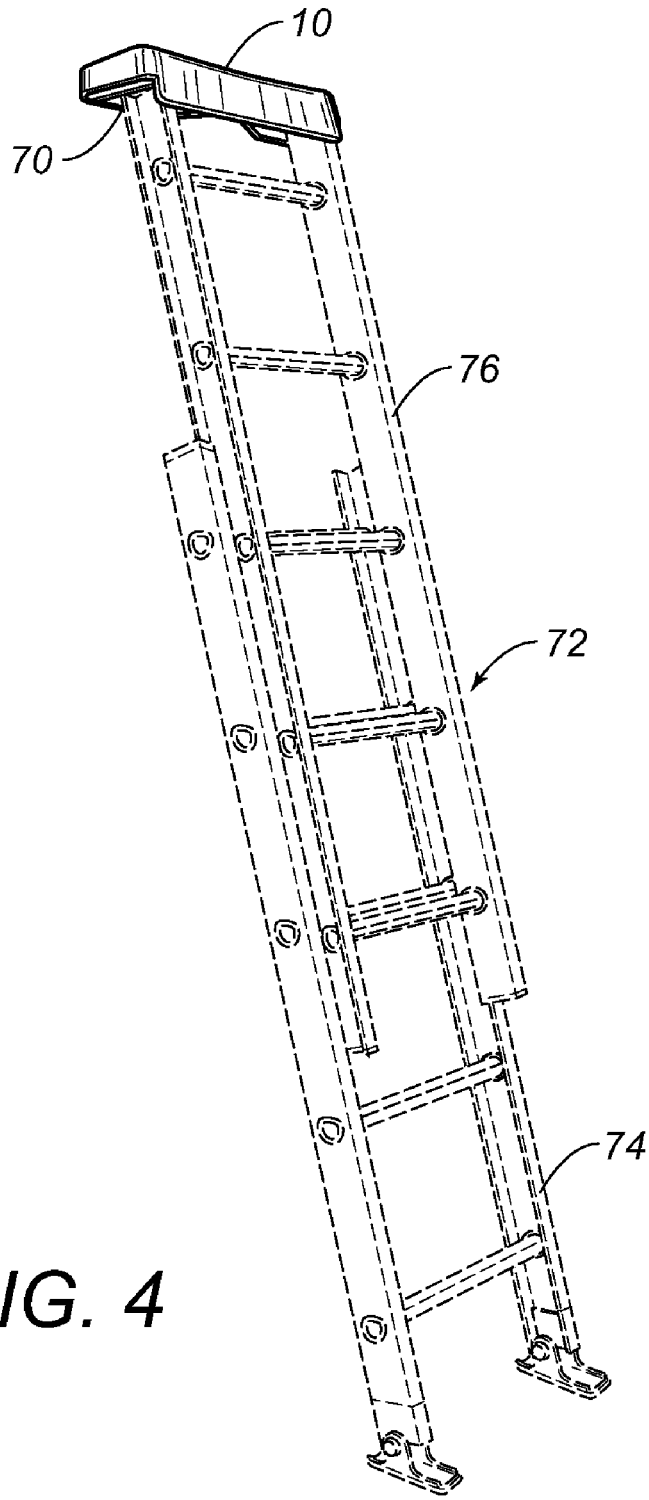
FIG. 4 is a perspective view showing the ladder cover of the present invention as applied to a ladder.

FIG. 4 illustrates the ladder top 10 as applied to the top end 70 of a ladder 72. The ladder 72 is an extension ladder that has a lower portion 74 and a slidable upper portion 76. This extension ladder allows the ladder top 10 to be moved to a desired location. The ladder top 10 of the present invention can also be applied to a wide variety of other ladders, such as step ladders, non-extension ladders, and similar devices.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A ladder top comprising:

a top panel extending in a horizontal plane;

a front side extending vertically downwardly from an edge of said top panel, said front side having a V-shape indentation formed in a center thereof, said top panel having a first slot formed therein in generally parallel-spaced relation to a side of said indentation and a second slot form therein in generally parallel-spaced relation to another side of said indentation, each of said first and second slots extending along a line so as to form a 90° angle with respect to each other, each of said first and second slots being enclosed by said top panel; and a fixing means connected to said top panel for maintaining said front side in juxtaposition against an extrinsic surface, said fixing means comprising a belt extending through each of said first and second slots, said belt extending below said top panel between said first and second slots, said front side having a plurality of ribs extending horizontally thereacross, said plurality of ribs having a plurality of indentations formed along a length thereof, said plurality of indentations of said plurality of ribs formed vertically in said plurality of ribs.

2. The ladder top of claim 1, said belt having a surface for extending around the extrinsic surface such that the extrinsic surface is interposed between the belt and said indentation.

3. The ladder top of claim 1, said belt having a tightening means cooperative therewith for tightening said belt against the extrinsic surface and for fixing said belt in the tightened position, said belt having an end, said tightening means for releasing said belt from the extrinsic surface upon pulling said end of said belt.

4. The ladder top of claim 1, said top panel having a pair of recessed pans formed therein, said first slot formed in one of said pair of recessed pans, said second slot formed in another of said pair of recessed pans.

5. The ladder top of claim 1, each of said first and second slots having a length of between ¾ inch and 1½ inches.

* * * * *